US008078073B2

(12) United States Patent
Kinouchi et al.

(10) Patent No.: US 8,078,073 B2
(45) Date of Patent: Dec. 13, 2011

(54) TEMPERATURE CONTROL OF A FIXING APPARATUS USING AN INDUCTION HEATING SYSTEM

(75) Inventors: Satoshi Kinouchi, Shinjuku-ku (JP); Osamu Takagi, Chofu (JP); Yoshinori Tsueda, Fuji (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 575 days.

(21) Appl. No.: 11/942,075

(22) Filed: Nov. 19, 2007

(65) Prior Publication Data

US 2008/0118262 A1 May 22, 2008

Related U.S. Application Data

(60) Provisional application No. 60/866,659, filed on Nov. 21, 2006.

(30) Foreign Application Priority Data

Oct. 1, 2007 (JP) ..... 2007-257742

(51) Int. Cl.
*G03G 15/20* (2006.01)

(52) U.S. Cl. ..... 399/69

(58) Field of Classification Search ..... 399/69, 399/70

See application file for complete search history.

(56) References Cited

U.S. PATENT DOCUMENTS

| | | | | |
|---|---|---|---|---|
| 6,725,009 | B1 * | 4/2004 | Tatematsu et al. | 399/329 |
| 7,139,495 | B2 | 11/2006 | Morihara et al. | |
| 7,155,136 | B2 * | 12/2006 | Nihonyanagi et al. | 399/69 |
| 7,203,439 | B2 | 4/2007 | Sone et al. | |
| 7,242,880 | B2 | 7/2007 | Sone et al. | |
| 2002/0003968 | A1 * | 1/2002 | Maruyama | 399/67 |
| 2006/0210329 | A1 * | 9/2006 | Tsueda et al. | 399/328 |

(Continued)

FOREIGN PATENT DOCUMENTS

JP 08220909 A * 8/1996

(Continued)

OTHER PUBLICATIONS

Computer translation of cited reference JP2005-321511A to Hayashizaki.*

*Primary Examiner* — Quana M Grainger
(74) *Attorney, Agent, or Firm* — Turocy & Watson, LLP

(57) ABSTRACT

In a fixing apparatus of an embodiment of the invention, a heat roller forwardly and reversely rotated by a drive motor capable of forwardly and reversely rotating is heated by an induction heating coil also when it is reversely rotated. Further, the roller control temperature of the heat roller by a control system is adjusted according to a time of forward rotation of the heat roller and a time of reverse rotation, or a time when the heat roller and a press roller are separated from each other and a time when they are in contact with each other. Besides, after a specified time has passed since an instruction of reverse rotation or forward rotation by a drive signal, output of the induction heating coil is tuned on.

15 Claims, 5 Drawing Sheets

U.S. PATENT DOCUMENTS

| | | | | |
|---|---|---|---|---|
| 2007/0047991 | A1 * | 3/2007 | Itoh et al. | 399/69 |
| 2007/0246457 | A1 | 10/2007 | Tsueda et al. | |
| 2007/0258725 | A1 * | 11/2007 | Hayashi | 399/70 |
| 2008/0118266 | A1 | 5/2008 | Nakayama et al. | |
| 2008/0237223 | A1 | 10/2008 | Kinouchi et al. | |
| 2008/0240805 | A1 | 10/2008 | Kinouchi et al. | |

FOREIGN PATENT DOCUMENTS

| | | | |
|---|---|---|---|
| JP | 2002-082549 | | 3/2002 |
| JP | 2004226807 | A * | 8/2004 |
| JP | 2005-321511 | | 11/2005 |
| JP | 2007155979 | A * | 6/2007 |

* cited by examiner

TEMPERATURE CONTROL OF A FIXING APPARATUS USING AN INDUCTION HEATING SYSTEM

CROSS REFERENCE TO RELATED APPLICATION

This invention is based upon and claims the benefit of priority from prior U.S. Patent Application 60/866,659 filed on Nov. 21, 2006 and Japanese Patent Application 2007-257742 filed on Oct. 1, 2007 the entire contents of which are incorporated herein by reference.

BACKGROUND OF THE INVENTION

1. Field of the Invention

The present invention relates to a fixing apparatus mounted in an image forming apparatus such as a copier, a printer or a facsimile, and particularly to a fixing apparatus of an image forming apparatus, which uses an induction heating system.

2. Description of the Background

Among induction heating fixing apparatuses used in image forming apparatuses such as electrophotographic copiers or printers, there is an apparatus which prevents a part of a fixing member from being excessively heated. For example, JP-A-2005-321511 discloses a fixing apparatus in which separation between a first fixing member and a second fixing member is detected, and power supply to a heat generating part is cut off. Besides, for example, JP-A-2002-82549 discloses a fixing apparatus in which after a heat generating roller in contact with a fixing belt starts a rotation operation, the heat generating roller is excited to generate heat.

However, as in the related art fixing apparatus, when the temperature control of the heat generating part is performed only by the timing of contact and separation of the fixing member, in the case where the fixing member having a small heat capacity is used, when the fixing members at the heating side and the pressure side come in contact with each other, a temperature drop in the fixing member becomes large. Thus, there is a fear that defective quality of fixing image occurs at the time of first copying.

Thus, in the induction heating fixing apparatus, it is desired that a fixing apparatus of an image forming apparatus is developed in which defective quality of fixing image due to a temperature drop in a heat generating member caused at the time of contact with an opposite member is prevented and a stable fixing property is obtained.

SUMMARY OF THE INVENTION

In an aspect of the present invention, there is provided a fixing apparatus of an image forming apparatus, which more suitably controls the temperature of a heat generating member, prevents defective quality of fixing image due to a temperature drop at the time of contact with an opposite member, and has a stable fixing property.

According to an embodiment of the present invention, a fixing apparatus includes a heat generating member having a metal conductive layer, an opposite member that comes in pressure contact with or is separated from the heat generating member, an induction current generating coil disposed around the heat generating member, a drive source to forwardly and reversely rotate at least the heat generating member, and a power supply unit that starts power supply to the induction current generating coil after rotation start of forward rotation or reverse rotation of the drive source and after a previously determined time has passed.

DETAILED DESCRIPTION OF THE INVENTION

Figure 1:
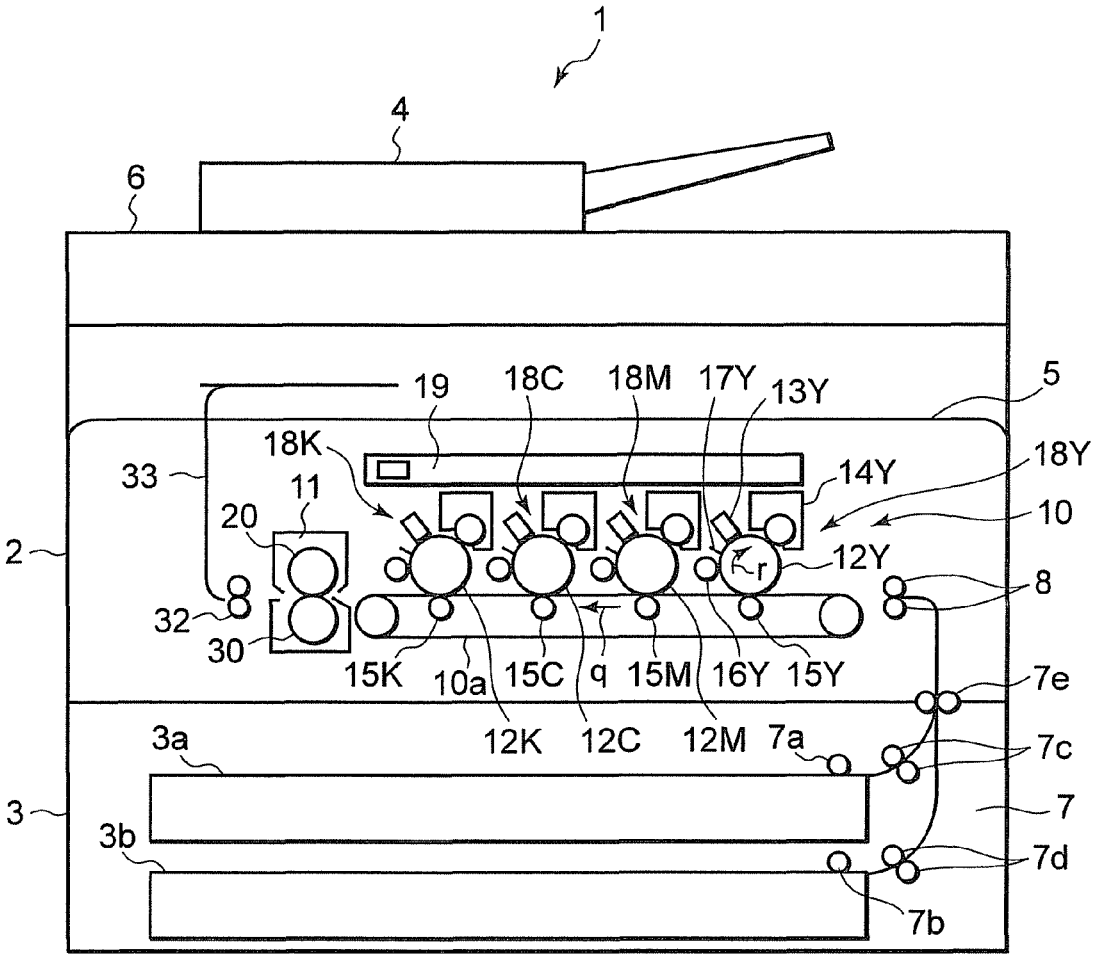
FIG. 1 is a schematic structural view showing an image forming apparatus of an embodiment.

Hereinafter, embodiments of the present invention will be described in detail with reference to the accompanying drawings. FIG. 1 is a schematic structural view showing an image forming apparatus 1 in an embodiment of the invention. The image forming apparatus 1 includes a scanner unit 6 to read an original document, and a paper feed unit 3 to supply a sheet paper P to a printer unit 2 to form an image. The scanner unit 6 converts image information read from an original document supplied from an automatic document feeder 4 provided at an upper surface into an analog signal.

The printer unit 2 includes an image forming unit 10 in which image forming stations 18Y, 18M, 18C and 18K of respective colors of yellow (Y), magenta (M), cyan (C) and black (K) are arranged in tandem along a transfer belt 10*a* rotated in an arrow q direction. Further, the image forming unit 10 includes a laser exposure device 19 to irradiate laser beams corresponding to image information to photoconductive drums 12Y, 12M, 12C and 12K of the image forming stations 18Y, 18M, 18C and 18K of the respective colors. Further, the printer unit 2 includes a fixing apparatus 11 and a paper discharge roller 32, and includes a paper discharge transport path 33 to transport the sheet paper P after fixing to a paper discharge unit 5.

The image forming station 18Y of yellow (Y) of the image forming unit 10 is constructed such that a charger 13Y, a developing device 14Y, a transfer roller 15Y, a cleaner 16Y, and a charge-removal unit 17Y are disposed around the photoconductive drum 12Y rotating in an arrow r direction. Each of the image forming stations 18M, 18C and 18K of the respective colors of magenta (M), cyan (C) and black (K) has the same structure as the image forming station 18Y of yellow (Y).

The paper feed unit 3 includes a first and a second paper feed cassettes 3*a* and 3*b*. Pickup rollers 7*a* and 7*b* to take out sheet papers from the paper feed cassettes 3*a* and 3*b*, separation transport rollers 7*c* and 7*d*, a transport roller 7*e* and a registration roller 8 are provided on a transport path 7 of the sheet paper P which extends from the paper feed cassettes 3*a* and 3*b* to the image forming unit 10.

When a print operation starts, in the image forming station 18Y of yellow (Y) of the printer unit 2, the photoconductive drum 12Y is rotated in the arrow r direction, and is uniformly charged by the charger 13Y. Next, the laser exposure device 19 irradiates the photoconductive drum 12Y with exposure light corresponding to the image information of yellow read by the scanner unit 6, and an electrostatic latent image is formed. Thereafter, the photoconductive drum 12Y is supplied with toner by the developing device 14Y, and an yellow (Y) toner image is formed on the photoconductive drum 12Y. The yellow (Y) toner image is transferred to the sheet paper P transported on the transfer belt 10*a* in the arrow q direction at the position of the transfer roller 15Y. After the transfer of the toner image is ended, the remaining toner on the photoconductive drum 12Y is cleaned by the cleaner 16Y, the electrical charge of the surface of the photoconductive drum 12Y is removed by the charge-removal unit 17Y, and next printing is enabled.

Also in the image forming stations 18M, 18C and 18K of the respective colors of magenta (M), cyan (C) and black (K), toner images are formed similarly to the yellow (Y) image forming station 18Y. The toner images of the respective colors formed by the image forming stations 18M, 18C and 18K are successively transferred at the positions of the transfer rollers 15M, 15C and 15K to the sheet paper P on which the yellow toner image has been formed. The sheet paper P on which the color toner images are formed in this way is heated, pressurized and fixed by the fixing apparatus 11, a print image is completed, and the sheet paper is discharged to the paper discharge unit 5.

Figure 3:
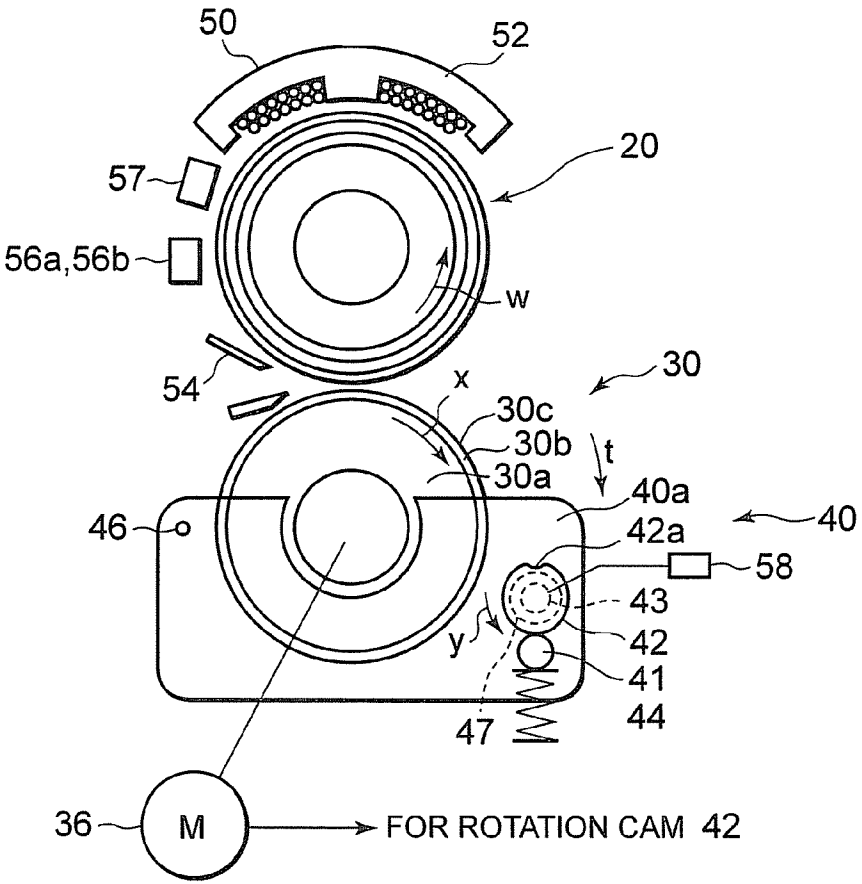
FIG. 3 is a schematic structural view showing the fixing apparatus in a state where the heat roller and the press roller are separated from each other in the embodiment of the invention.
Figure 2:
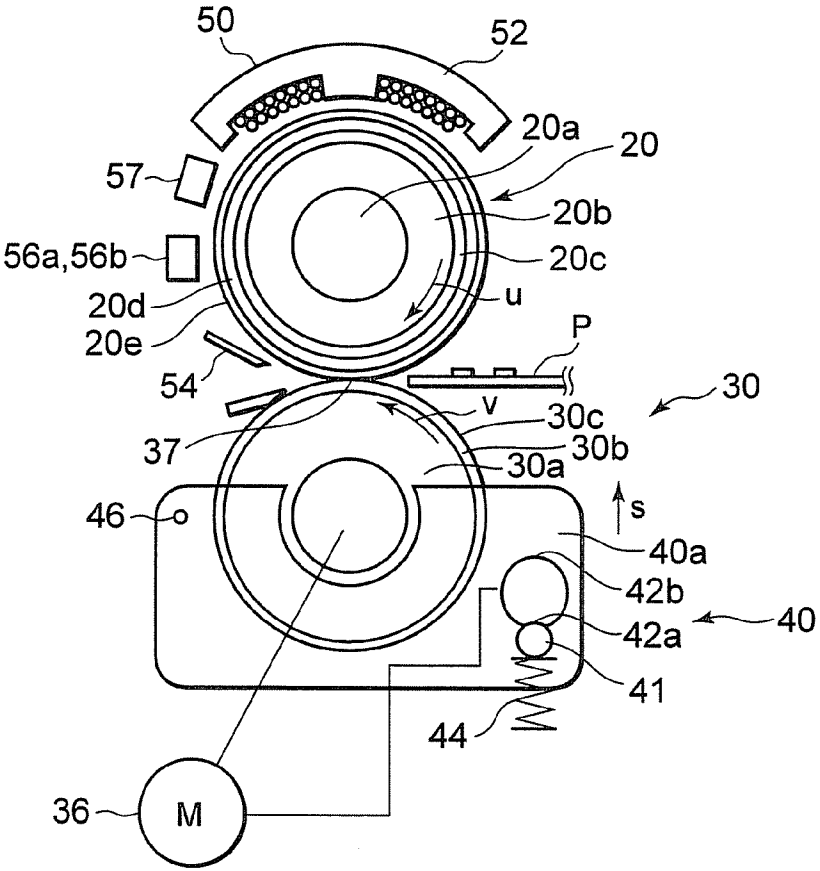
FIG. 2 is a schematic structural view showing a fixing apparatus in a state where a heat roller and a press roller are in pressure contact with each other in the embodiment of the invention.

Next, the fixing apparatus 11 will be described. FIG. 2 is a schematic structural view showing the fixing apparatus 11, and shows a state in which a heat roller 20 as a heat generating member and a press roller 30 as an opposite member are in pressure contact with each other. FIG. 3 shows a state in which the heat roller 20 and the press roller 30 are separated from each other. The fixing apparatus 11 includes the heat roller 20 and the press roller 30 each having a diameter of 40 mm. The heat roller 20 and the press roller 30 are rotated forwardly and reversely by a drive motor for fixing unit 36 which is a drive source and can rotate forwardly and reversely.

The press roller 30 is brought into pressure contact with the heat roller 20 by a pressure mechanism 40 and is separated from the heat roller 20. When the heat roller 20 and the press roller 30 are brought into pressure contact with each other by the pressure mechanism 40, a nip 37 having a definite width is formed between the heat roller 20 and the press roller 30. The sheet paper P passes through the nip 37 between the heat roller 20 and the press roller 30, so that the toner image on the sheet paper P is heated, pressurized and fixed.

The pressure mechanism 40 includes a metal plate 40*a* to support the press roller 30, a spring 44 to push up a shaft 41 provided on the metal plate 40*a*, and a rotation cam 42 to come in contact with the shaft 41. The rotation cam 42 is rotated only at the time of reverse rotation of the drive motor 36 through a one-way clutch 47.

When a recess 42*a* of the rotation cam 42 is in contact with the shaft 41, the shaft 41 of the metal plate 40*a* is pushed up by the elastic force of the spring 44, and the metal plate 40*a* receives a force of rotating in an arrow s direction around a supporting point 46. By this, the heat roller 20 and the press roller 30 are brought into pressure contact with each other. On the other hand, when a projection 42*b* of the rotation cam 42 is in contact with the shaft 41, the shaft 41 is pushed down against the elastic force of the spring 44, and the metal plate 40*a* receives a force of rotating in an arrow t direction around the supporting point 46. By this, the heat roller 20 and the press roller 30 are separated from each other. The amount of rotation of the rotation cam 42 is detected by an encoder 58 connected to the cam shaft 43.

The drive motor 36 is coupled to the press roller 30 and the rotation cam 42. Further, a drive unit of the press roller 30 is coupled to the heat roller 20 through a gear. By this, even in the state where the heat roller 20 and the press roller 30 are separated from each other, the heat roller 20 is rotated and driven. When the drive motor 36 is forwardly rotated and driven, the heat roller 20 is rotated in an arrow u direction, and the press roller 30 is rotated in an arrow v direction. When the drive motor 36 is reversely rotated and driven, the heat roller 20 is rotated in an arrow w direction, and the press roller 30 is rotated in an arrow x direction. In addition to this, when the drive motor 36 is reversely rotated and driven, the rotation cam 42 is rotated in an arrow y direction.

Incidentally, at the time of the forward rotation driving of the drive motor 36, the heat roller 20 may be driven by the press roller 30. However, in that case, a torque limiter is provided on the gear to couple the press roller 30 and the heat roller 20, and in the case where the rotation of the heat roller 20 is delayed, driving of the drive motor 36 may be transmitted to the heat roller 20.

The heat roller 20 includes, around a metal shaft 20*a*, a foamed rubber (sponge) 20*b* having a thickness of 5 mm, a metal conductive layer 20*c* made of nickel (Ni) and having a thickness of 40 μm, a solid rubber layer 20*d* having a thickness of 200 μm, and a release layer 20*e* having a thickness of 30 μm. The metal conductive layer 20*c* is not limited to nickel, but may be stainless, aluminum, or composite material of stainless and aluminum. The metal conductive layer 20*c*, the solid rubber layer 20*d*, and the release layer 20*e* may be constructed such that they are integrated, are not bonded to the foamed rubber (sponge) 20*b*, and are made slidable with respect to the foamed rubber (sponge) 20*b*.

The press roller 30 includes a metal shaft 30*a* having a thickness of 2 mm, a solid silicone rubber layer 30*b* having a thickness of 1 mm, and a release layer 30*c* having a thickness of 30 μm.

An induction heating coil 50 to heat the metal conductive layer 20*c* of the heat roller 20 through a specified gap is provided at the outer periphery of the heat roller 20. Further, a peel pawl 54 to prevent the winding of the sheet paper P after fixing, a first and a second infrared sensors 56*a* and 56*b* of a thermopile system, which are temperature sensors to detect the surface temperature of the heat roller 20, and a thermostat 57 to detect abnormality of the surface temperature of the heat roller 20 and to cut off heating are provided at the outer periphery of the heat roller 20. The peel pawl 54 may be of a contact type or a non-contact type. The first infrared sensor 56*a* monitors the temperature of substantially the center part of the heat roller 20, and the second infrared sensor 56*b* monitors the temperature of the edge part of the heat roller 20.

The induction heating coil 50 has substantially coaxial shape as the heat roller 20, and is formed by winding wire rods around the magnetic core 52 to concentrate a magnetic flux into the heat roller 20. As the wire rod, for example, a litz wire is used which is constructed by bundling plural copper wire rods coated with heat-resistant polyamide-imide and insulated from each other. The wire rod is made the litz wire, so that the diameter of the wire rod can be made smaller than the penetration depth of a magnetic field. By this, it becomes possible to cause high-frequency current to effectively flow to the wire rod. In this embodiment, 19 copper wire rods each having a diameter of 0.5 mm are bundled to form the litz wire.

When a specified high-frequency current is applied to the litz wire as stated above, the induction heating coil 50 generates a magnetic flux. By this magnetic flux, an eddy-current is generated in the metal conductive layer 20*c* so as to prevent the change of the magnetic field. Joule heat is generated by the eddy-current and the resistance value of the metal conductive layer 20*c*, and the heat roller 20 is instantaneously heated.

Figure 4:
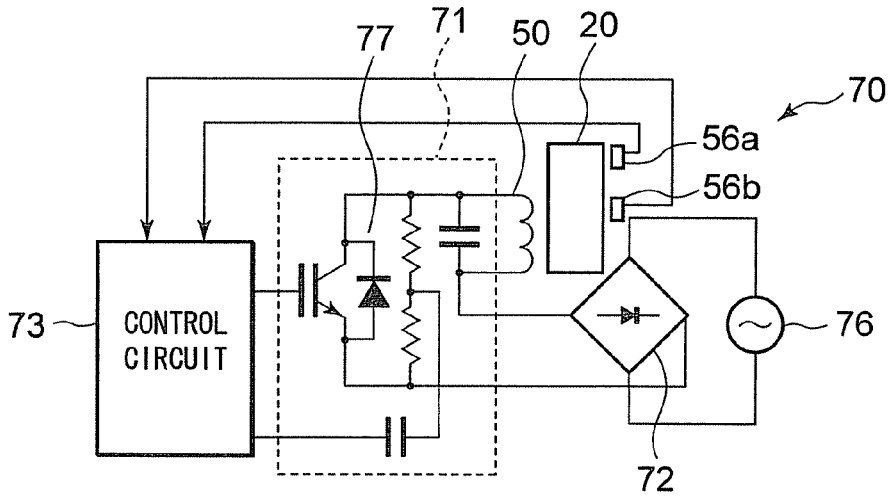
FIG. 4 is a schematic block diagram showing a control system using a quasi-E class inverter circuit in the embodiment of the invention.

Next, control of the induction heating coil 50 to heat the heat roller 20 will be described. FIG. 4 shows a control system 70 as a temperature controller using a quasi-E class inverter circuit 71. The control system 70 includes the inverter circuit 71 to supply drive current to the induction heating coil 50, a rectifier circuit 72 to rectify current from a commercial AC power source 76 and to supply it to the inverter circuit 71, and a control circuit 73. The control circuit 73 controls the whole image forming apparatus 1, and feedback controls high-frequency current applied to the induction heating coil 50 by the inverter circuit 71 according to the detection result of the infrared sensors 56*a* and 56*b*. The quasi-E class inverter circuit 71 controls the on-off time of a single switching element 77 by the control circuit 73, and changes the drive frequency of the current applied to the induction heating coil 50 within the range of from 20 to 100 kHz. By changing the drive frequency, for example, power of 200 W to 1500 W can be supplied to the induction heating coil 50. An IGBT, a MOSFET or the like which has high withstand voltage and can be used with a large current is used as the switching element 77.

Figure 5:
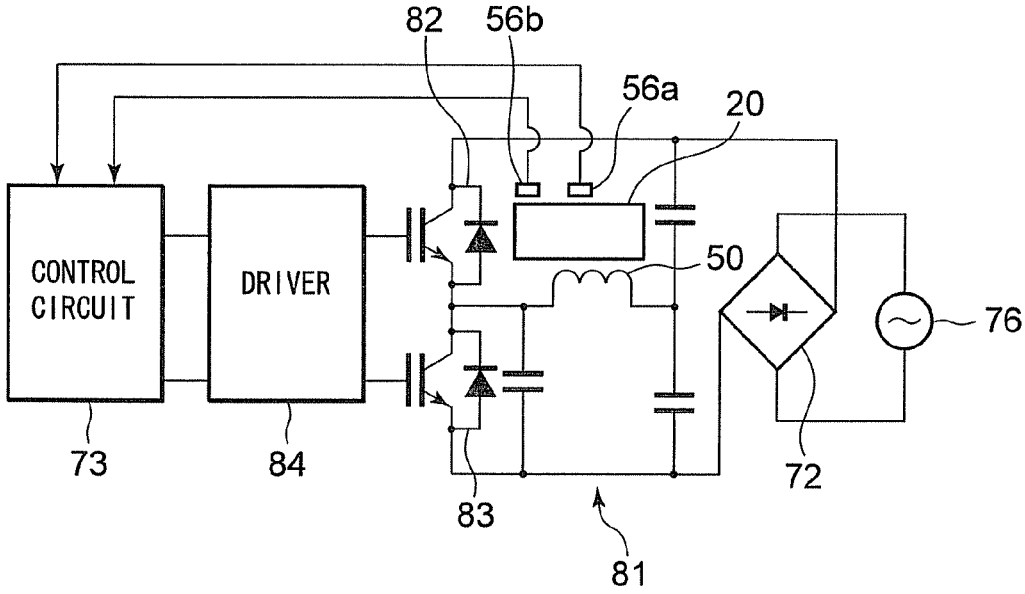
FIG. 5 is a schematic block diagram showing a control system using a half-bridge inverter circuit in the embodiment of the invention.

As shown in FIG. 5, a control system 80 may use a half-bridge inverter circuit 81. The half-bridge inverter circuit 81 controls the on-off time of two switching elements 82 and 83 by a driver 84 driven by a control circuit 73.

Figure 6:
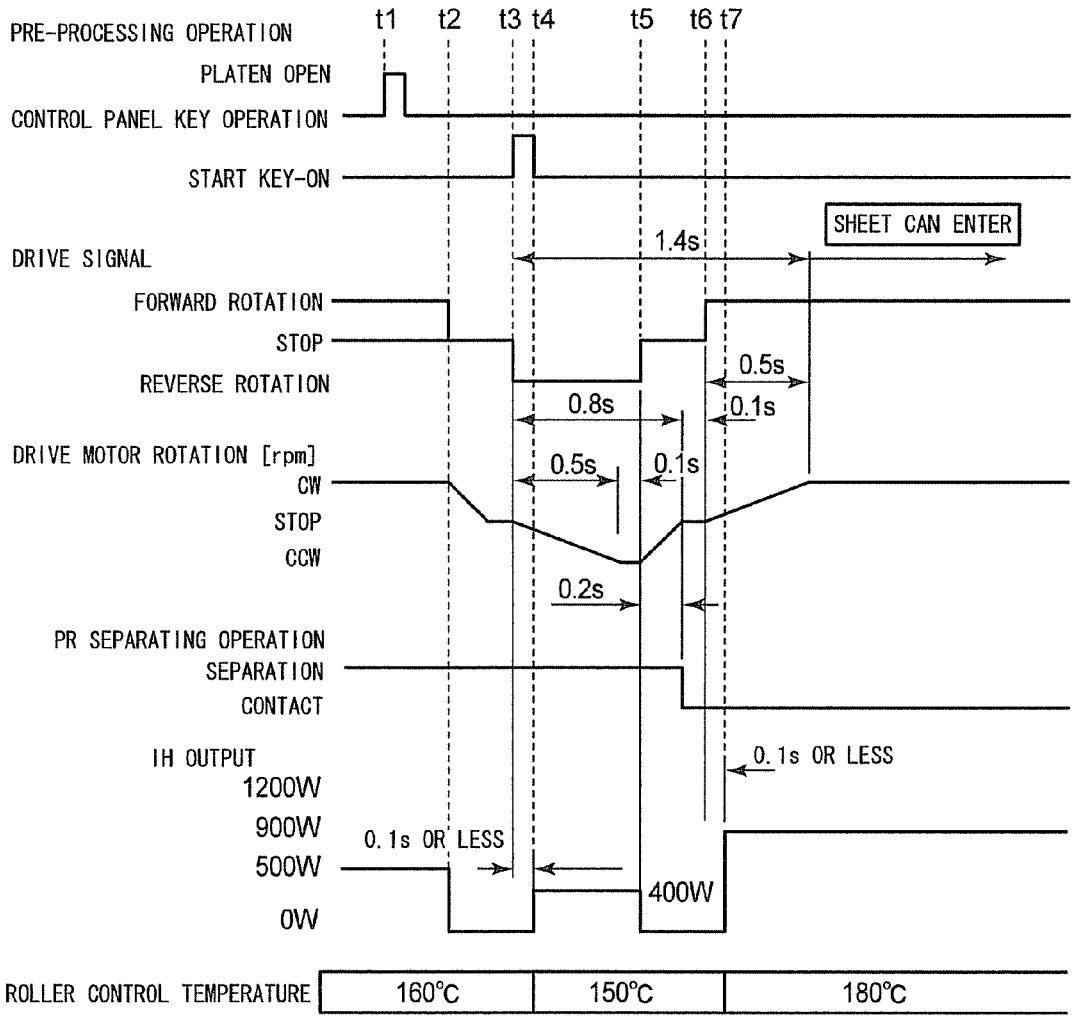
FIG. 6 is a sequence chart showing current application to an induction heating coil in the embodiment of the invention.

Next, a description will be given to application of high-frequency current to the induction heating coil 50 corresponding to the timing of contact and separation between the heat roller 20 and the press roller 30 and the start timing of the drive motor 36. FIG. 6 shows a sequence chart of the application of the high-frequency current to the induction heating coil 50 after a standby mode (state in which printing is immediately enabled when a print instruction is issued) has occurred. In the standby mode of the image forming apparatus 1, the roller control temperature of the heat roller 20 by the control system 70 is set to 160° C. At the time of the standby mode, a power of 500 W is applied to the induction heating coil 50. The rotation cam 42 is at the position where the projection 42*b* is in contact with the shaft 41, and the heat roller 20 and the press roller 30 are separated from each other. Further, the drive motor 36 is forwardly rotated, the heat roller 20 is rotated in the arrow u direction, and the press roller 30 is rotated in the arrow v direction. At this time, the heat roller 20 and the press roller 30 are separated from each other, heat release from the heat roller 20 to the press roller 30 is small, and it is easy to keep the temperature of the heat roller 20. Accordingly, the roller control temperature is set to be as low as 160° C.

At time t1 during the standby mode, a pre-processing operation for print operation start is performed (a platen is opened at the time when an original document is placed on the scanner unit 6, or a control panel key of the image forming apparatus 1 is operated in order to set an image formation condition). Next, in order to bring the heat roller 20 and the press roller 30 into pressure contact with each other, at time t2, a drive signal for the drive motor issues an instruction to stop the drive motor 36. At the same time as this, the output of the induction heating coil 50 is turned OFF. Although the output of the induction heating coil 50 is immediately stopped, in the drive motor 36, there occurs a time difference from the issuance of the stop instruction to the stop.

Next, at time t3, when a start key of the control panel of the image forming apparatus 1 is turned on, the drive signal issues an instruction to rotate the drive motor 36 reversely. Thereafter, at time t4 after a previously determined definite time, for example, 0.1 second has passed, the output of the induction heating coil 50 is turned on. This is because consideration is given to the delay between the time when the drive signal is issued and the time when the heat roller 20 is actually rotated reversely by the drive motor 36. By this, it is prevented that a part of the heat roller 20 is rapidly heated. Incidentally, after the instruction to perform the reverse rotation is issued from the drive signal at time t3, it takes about 0.5 seconds until the reverse rotation of the drive motor 36 is stabilized.

The heat roller 20 is rotated in the arrow w direction by the reverse rotation of the drive motor 36, and the press roller 30 is rotated in the arrow x direction. Besides, the rotation cam 42 is rotated in the arrow y direction through the one-way clutch 47. Thereafter, the rotation cam 42 stops at the position where the recess 42*a* comes in contact with the shaft 41. The amount of rotation of the rotation cam 42 from the position where the projection 42*b* of the rotation cam 42 comes in contact with the shaft 41 to the position where the recess 42*a* comes in contact with the shaft 41 is detected by the encoder 58. The recess 42*a* of the rotation cam 42 comes in contact with the shaft 41, so that the metal plate 40*a* receives the force of rotating in the arrow s direction around the supporting point 46, and brings the press roller 30 into pressure contact with the heat roller 20. Incidentally, it take about 0.8 seconds for the press roller 30 to come in pressure contact with the heat roller 20 after the instruction to perform the reverse rotation is issued from the drive signal at time t3.

While the heat roller 20 is rotated reversely in the arrow w direction until the recess 42*a* of the rotation cam 42 comes in contact with the shaft 42, the roller control temperature of the heat roller 20 by the control system 70 is set to 150° C. This is because the time required by the heat roller 20 to reach the infrared sensors 56*a* and 56*b* after passing the induction heating coil 50 is changed between the time of forward rotation of the heat roller 20 and the time of reverse rotation. As compared with case where the heat roller 20 is rotated forwardly, in the case of the reverse rotation, the heat generating portion of the heat roller 20 immediately reaches the infrared sensors 56*a* and 56*b*.

Accordingly, an influence due to the heat radiation of the heat roller 20 after heat generation is small, a time lag between the induction heating coil 50 and the infrared sensors 56*a* and 56*b* is liable to occur, and a temperature ripple is liable to become large. Thus, in order to prevent the temperature ripple from becoming large, at the time of the reverse rotation of the heat roller 20, as compared with the time of the standby mode, the roller control temperature by the control system 70 is set to be lower by 10° C. Besides, at the time of the reverse rotation of the heat roller 20, the power of the induction heating coil 50 is reduced to 400 W. As stated above, the roller control temperature by the control system 70 and the power of the induction heating coil 50 are reduced, so that the temperature ripple at the time of the reverse rotation of the heat roller 20 can be reduced.

Thereafter, when the encoder 58 detects a specified value, at time t5 (after about 0.1 second after the reverse rotation of the drive motor 36 is stabilized), the drive signal issues an instruction to stop the drive motor 36. At the same time as this, the output of the induction heating coil 50 is turned off. Thereafter, at time t6 (after about 0.1 second after the press roller 30 comes in pressure contact with the heat roller 20) after the drive motor 36, which was rotated reversely, is stopped, the drive signal issues an instruction to rotate the drive motor 36 forwardly. Incidentally, the time from the state where the press roller 30 is separated to the state where it comes in pressure contact with the heat roller 20 is not limited.

For example, the time from the state where the press roller 30 is separated to the state where it comes in pressure contact with the heat roller 20 (the time required to reach the position where the recess 42*a* comes in contact with the shaft 41 from the position where the protrusion 42*b* of the rotation cam 42 comes in contact with the shaft 41) is set to be long, and the heat roller 20 or the press roller 30 may be rotated plural times during this. By doing so, even in the case where a specific part of the heat roller 20 is continuously heated by the induction heating coil 50 in both the forward and the reverse rotations of the heat roller 20, the temperature ripple can be prevented.

A delay between the issuance of the forward rotation instruction by the drive signal and the start of the forward rotation of the heat roller 20 by the drive motor 36 is taken into consideration, and the output of the induction heating coil 50 is turned on at time t7 where a previously determined definite time, for example, 0.1 second has passed. In the fixing mode in which the heat roller 20 is forwardly rotated in the arrow u direction in the state where the heat roller 20 and the press roller 30 are pressure contact with each other, the roller control temperature of the heat roller 20 by the control system 70 is set to be as high as 180° C.

This is because at the time of the fixing mode, the press roller 30 is in contact with the heat roller 20, and the heat is absorbed by the press roller 30 side, and accordingly, as compared with the time of the standby mode, a temperature drop in the heat roller 20 becomes large. Incidentally, even if the roller control temperature is made high, since the time required by the heat roller 20 to reach the infrared sensors 56*a* and 56*b* is long after the heat generation by the induction heating coil 50, there is no fear that a problem due to the temperature ripple occurs at the time of detection by the infrared sensors 56*a* and 56*b*. Thus, at the time of the fixing mode, as compared with the time of the standby mode, the roller control temperature by the control system 70 is set to be higher by 20° C. The power of the induction heating coil 50 at the time of the fixing mode is set to 900 W.

At time t6, after the forward rotation instruction is issued from the drive signal, about 0.5 seconds is required before the forward rotation of the drive motor 36 is stabilized. Accordingly, when 0.5 seconds have passed from the time t6, the heat roller 20 and the press roller 30 are respectively stably rotated in the arrow u direction and the arrow v direction, and the fixing apparatus 11 can perform fixing. At the time of the fixing mode, after the sheet paper P having the toner image passes between the heat roller 20 and the press roller 30, in the case where a specified time has passed, the fixing apparatus 11 is put in the standby mode. In the standby mode, the heat roller 20 and the press roller 30 are separated from each other, the roller control temperature of the control system 70 is reduced to 160° C., and waiting is made for the start of a next print operation.

According to the fixing apparatus 11 of this embodiment, the heat roller 20 forwardly and reversely rotated by the drive motor 36 capable of forwardly and reversely rotating is heated by the induction heating coil 50 also during the reverse rotation. Further, the roller control temperature of the heat roller 20 by the control system 70 is adjusted according to the time of the forward rotation of the heat roller 20 and the time of the reverse rotation, or the time when the heat roller 20 and the press roller 30 are separated from each other or the time when they are in contact with each other. That is, the heat generation of the heat roller 20 is more finely controlled.

Accordingly, even if the heat release occurs between the contact and separation operation of the heat roller 20 and the press roller 30, or the heat of the heat roller 20 is absorbed through the pressure contact with the press roller 30, the temperature drop of the heat roller 20 can be reduced. As a result, for example, even in the case where the heat capacity of the heat roller 20 is small, the temperature drop of the heat roller 20 is reduced, and the fixing temperature can be kept. By this, it is possible to prevent defective quality of fixing image from occurring due to insufficient heat generation of the heat roller 20 at the time of first copying, and a high quality fixed image can be obtained. Further, the roller control temperature of the heat roller 20 by the control system 70 is adjusted, so that a rapid temperature change does not occur at a part of the heat roller 20, and a uniform and excellent fixed image can be obtained.

Besides, according to the fixing apparatus 11 of the embodiment, after 0.1 second has passed since the instruction of the reverse rotation by the drive signal at time t2, or 0.1 second has passed from the instruction of the forward rotation by the drive signal at time t6 and after the drive motor 36 is actually rotated, the output of the induction heating coil 50 is tuned on. Accordingly, there is no fear that the heat roller 20 is heated by the induction heating coil 50 before the rotation of the heat roller 20. As a result, it is possible to prevent a part of the heat roller 20 from being rapidly heated, and a uniform and excellent fixed image can be obtained.

Incidentally, the invention is not limited to the above embodiment, and various modifications can be made within the scope of the invention, for example, the time required to reach the state where the heat generating member and the opposite member are in pressure contact with each other from the state where the heat generating member and the opposite member are separated from each other is arbitrary. Besides, the roller control temperature of the temperature controller to perform the temperature control of the heat generating member is also arbitrary according to the heat capacity of the heat generating member and the like. Further, the previously determined time elapsed before the power supply to the induction heating coil is started after the start of the forward rotation or reverse rotation of the drive source is also not limited. The delay between the start of rotation of the drive source and the actual rotation of the heat generating member has only to be covered.

Figure 7:
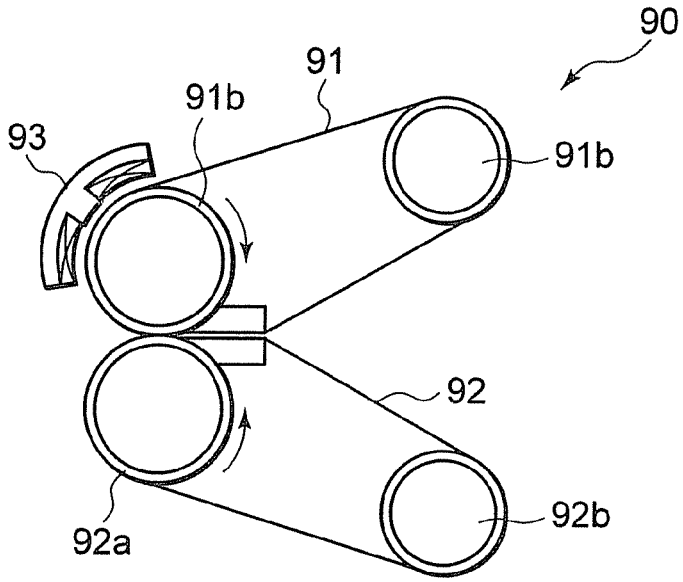
FIG. 7 is a schematic structural view showing a fixing apparatus in a state where a heat generating belt and a press belt are in pressure contact with each other in a first modified example of the invention.
Figure 8:
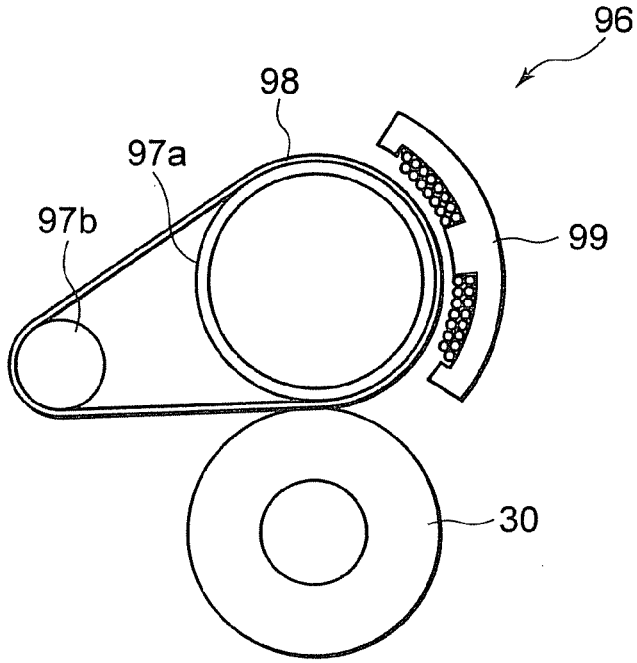
FIG. 8 is a schematic structural view showing a fixing apparatus in a state where a heat generating belt and a press roller are in pressure contact with each other in a second modified example of the invention.

Further, as shown in a first modified example of FIG. 7, a heat generating member of a fixing apparatus 90 may be made a heat generating belt 91 which is supported by support rollers 91*a* and 91*b* and is rotated forwardly and reversely, and an opposite member may be made an opposite belt 92 which is supported by support rollers 92*a* and 92*b* and is rotated forwardly and reversely. In this first modified example, the heat generating belt 91 rotated forwardly and reversely is heated by an induction current generating coil 93. Further, as shown in a second modified example of FIG. 8, a heat generating member of a fixing apparatus 96 may be made a heat generating belt 98 which is supported by support rollers 97*a* and 97*b* and is rotated forwardly and reversely, and is brought into pressure contact with a press roller 30. In this second modified example, the heat generating belt 98 rotated forwardly and reversely is heated by an induction current generating coil 99. Besides, the shape, characteristics and the like of the induction current generating coil are also not limited.

What is claimed is:

1. A fixing apparatus comprising:

a heat generating member configured to have a metal conductive layer;

an opposite member configured to form a nip between the heat generating member and the opposite member;

a contact and separation mechanism configured to contact and separate the heat generating member to and from the opposite member;

an induction current generating coil disposed around the heat generating member;

a drive source configured to rotate the heat generating member forwardly and reversely;

a temperature sensor disposed downstream from the nip of the heat generating member and upstream from the induction current generating coil of the heat generating member at a time of forward rotation of the heat generating member; and a power controller configured to control a power of the induction current generating coil, and based on the direction of rotation of the heat generating member to apply a prescribed power to the induction current generating coil, the power controller applies a lower power to the induction current generating coil at the time of reverse rotation of the heat generating member compared with a power applied at the time of forward rotation of the heat generating member.

2. The fixing apparatus according to claim 1, wherein the power controller adjusts the power according to a time required to reach the temperature sensor from an edge of the induction current generating coil at the time of the forward rotation of the heat generating member, and a time required to reach the temperature sensor from the edge of the induction current generating coil at the time of the reverse rotation of the heat generating member.

3. The fixing apparatus according to claim 1, wherein the heat generating member can be adjusted to control temperature between a time when the heat generating member and the opposite member are in pressure contact with each other and a time when the heat generating member and the opposite member are separated from each other.

4. The fixing apparatus according to claim 3, wherein the heat generating member can be adjusted to a first temperature when the heat generating member and the opposite member are in pressure contact with each other, and can be adjusted to a second temperature lower than the first temperature when the heat generating member and the opposite member are separated from each other.

5. The fixing apparatus according to claim 1, wherein the contact and separation mechanism comprises a pressure member configured to push the heat generating member and the opposite member in a direction of contact, and a rotation cam that is rotated at a time of the reverse rotation of the drive source and configured to release a pressure force of the pressure member, and the drive source drives the rotation cam by the reverse rotation.

6. The fixing apparatus according to claim 1, further wherein the power controller applies a lower power to the induction current generating coil when the heat generating member and the opposite member are separated from each other, a power when the heat generating member and the opposite member are in contact with each other.

7. An image forming apparatus comprising:

an image forming portion configured to form a toner image on a recording medium;

a heat generating member configured to have a metal conductive layer;

an opposite member configured to form a nip between the heat generating member;

a contact and separation mechanism configured to contact and separate the heat generating member to and from the opposite member;

an induction current generating coil disposed around the heat generating member;

a drive source configured to rotate the heat generating member forwardly and reversely;

a temperature sensor disposed downstream from the nip of the heat generating member and upstream from the induction current generating coil of the heat generating member at a time of forward rotation of the heat generating member; and a power controller configured to control a power of the induction current generating coil, and based on the direction of rotation of the heat generating member to apply a prescribed power to the induction current generating coil, the power controller applies a lower power to the induction current generating coil at the time of reverse rotation of the heat generating member compared with a power applied at the time of forward rotation of the heat generating member.

8. The apparatus according to claim 7, wherein the power controller adjusts the power according to a time required to reach the temperature sensor from an edge of the induction current generating coil at the time of the forward rotation of the heat generating member, and a time required to reach the temperature sensor from the edge of the induction current generating coil at the time of the reverse rotation of the heat generating member.

9. The apparatus according to claim 7, wherein the heat generating member can be adjusted to a control temperature between a time when the heat generating member and the opposite member are in pressure contact with each other and a time when the heat generating member and the opposite member are separated from each other.

10. The apparatus according to claim 9, wherein the heat generating member can be adjusted to a first temperature when the heat generating member and the opposite member are in pressure contact with each other, and can be adjusted to a second temperature lower than the first temperature when the heat generating member and the opposite member are separated from each other.

11. The apparatus according to claim 7, wherein the contact and separation mechanism comprises a pressure member configured to push the heat generating member and the opposite member in a direction of contact, and a rotation cam that is rotated at a time of the reverse rotation of the drive source and configured to release a pressure force of the pressure member, and the drive source drives the rotation cam by the reverse rotation.

12. The apparatus according to claim 7, wherein the power controller applies a lower power to the induction current generating coil when the heat generating member and the opposite member are separated from each other than a power when the heat generating member and the opposite member are in contact with each other.

13. A control method of a fixing apparatus, comprising:

separating a heat generating member and an opposite member;

heating the heat generating member;

detecting a temperature of the heat generating member at a position downstream from a nip and a position upstream from a heating position at a time of forward rotation of the heat generating member; and controlling a power to heat the heat generating member lower at the time of the reverse rotation of the heat generating member than a power to heat the heat generating member at the time of the forward rotation of the heat generating member based on a direction of rotation of the heat generating member.

14. The method according to claim 13, further comprising adjusting power to heat the heat generating member based upon a time difference between a time of the heat generating member reaching the heating position after heating during forward rotation and a time of the heat generating member reaching the heating position after heating during reverse rotation.

15. The method according to claim 13, further comprising controlling the heat generating member at a first temperature when the heat generating member and the opposite member are in contact with each other, and controlling the heat generating member at a second temperature when the heat generating member and the opposite member are separate from each other.

* * * * *